US005613180A

United States Patent [19]

Kosco

[11] Patent Number: 5,613,180

[45] Date of Patent: Mar. 18, 1997

[54] HIGH DENSITY FERROUS POWER METAL ALLOY

[75] Inventor: John C. Kosco, St. Marys, Pa.

[73] Assignee: Keystone Investment Corporation, Wilmington, Del.

[21] Appl. No.: 315,635

[22] Filed: Sep. 30, 1994

[51] Int. Cl.[6] ..... B22F 1/00

[52] U.S. Cl. ..... 419/5; 419/11; 419/45; 419/55; 419/59; 75/243; 428/551

[58] Field of Search ..... 419/5, 11, 45, 419/55, 59; 75/243; 428/551

[56] References Cited

U.S. PATENT DOCUMENTS 2,191,936 2/1938 Lenel .
2,333,573 11/1942 Kalischer .
2,411,073 11/1946 Whitney .
2,489,839 11/1949 Whitney .
2,827,407 3/1958 Carlson et al. .
5,476,632 12/1995 Shivanath et al. ..... 419/57
5,512,326 4/1996 Jones et al. ..... 419/28
5,516,483 5/1996 Sivanath et al. ..... 419/14

*Primary Examiner*—Charles T. Jordan
*Assistant Examiner*—Anthony R. Chi
*Attorney, Agent, or Firm*—Kirkpatrick & Lockhart LLP

[57] ABSTRACT

A method for producing high density and/or high surface density ferrous powder metal parts has the steps of: compacting a iron-containing powder substantially free of graphite at room temperature and at about 40–50 tsi; sintering the green compact in an inert, non-oxidizing environment at a temperature of about 2050°–2300° F.; repressing the sintered compact at room temperature at about 60 tsi; carburizing the repressed compact at high temperature to form a layer of relatively high carbon concentration to a depth of at least about 0.010 inches; and immediately quenching the hot carburized compact followed by a tempering treatment.

48 Claims, 1 Drawing Sheet

HIGH DENSITY FERROUS POWER METAL ALLOY

BACKGROUND OF THE INVENTION

1. Field of the Invention

The present invention relates to a process for producing ferrous powder metal parts, and particularly relates to a process for producing ferrous powder metal parts having high surface hardness and superior rolling contact fatigue properties.

2. Description of the Invention Background

Many useful mechanical properties of powder metal ("P/M") parts improve with increases in part density. This relationship is particularly valid for dynamic properties of parts such as impact fatigue and rolling contact fatigue, which may increase dramatically as part density approaches theoretical density. Increasing the density of a P/M part reduces the prevalence of pores. Fatigue cracks typically originate at the sharp edges of pore sites and failure of the entire part may result from these cracks.

The increased fatigue properties resulting from increased density are of prime importance in the operation of structural components which undergo high cyclic stresses during operation. Components such as gears, cams and sprockets are in continuous high-stress rolling contact and may crack, break, or splinter after continuous contact under heavy load. P/M parts subjected to the cyclic stress of repeated rolling contact must also have high surface hardness. However, P/M parts with high densities typically do not have high surface hardness absent additional treatment procedures.

There are a number of known techniques for producing high density ferrous P/M parts. One such technique is simply the use of purer iron powders in a conventional mold and sinter cycle. Purer iron powders result in enhanced part density because interstitial impurities, particularly carbon but also oxygen and nitrogen, reduce the compressibility of iron powders. Current technology yields maximum green densities of 7.2–7.4 g/cc (92–94% of theoretical maximum density) by molding pure iron powder at 60 tsi (tons per square inch). Green density refers to the density of a green compact, i.e., a compacted powder mass, which has not been sintered. The green compact is then sintered at about 2050°–2300° F., typically in a vacuum furnace or in the inert gas environment of the heating zone of a belt or pusher furnace incorporating silicon carbide heating elements. Weight loss and expansion during sintering typically reduces the maximum final density of sintered compacts produced by from pure iron powder by this "mold-sinter" process to between about 6.8–7.3 g/cc.

Lower maximum final densities are achieved if iron alloy powders are used in a mold-sinter process. However, recently available molybdenum-iron alloy powders can be processed to approximately 7.25 g/cc density by a mold and sinter cycle. Parts produced by the mold-sinter process generally have low strength and surface hardness and must be subjected to additional procedures to improve structural properties such as strength, hardness and toughness.

A second technique to produce high density ferrous P/M parts is the double press/double sinter process. In that process, a mix of iron powder and/or iron alloy powder is blended with loose graphite powder, and possibly with other alloy additives, and is molded at room temperature at about 30–50 tsi. The green compact ms then pre-sintered at approximately 1600° F. to provide a pre-sintered compact having a density of 6.8–7.2 g/cc. The pre-sinter temperature is selected to minimize the solution of carbon in the ferrous compact. Because the pre-sintering temperature allows minimal solution of carbon in the iron, the pre-sinter anneals and softens the iron so it can be further worked. If the pre-sinter temperature is too high, solution of carbon in the iron will make it much stronger and very resistant to subsequent working. After pre-sintering, the compact is placed back into the die and is re-pressed at room temperature and about 50–60 tsi, resulting in a re-pressed compact with a density of about 7.2–7.5 g/cc. Finally, the repressed compact is sintered a second time at about 2050°–2300° F.

The double press/double sinter process typically produces parts in the 7.3–7.5 g/cc range having properties significantly improved relative to parts produced by a mold-sinter process. The repressed parts may then be heat treated to improve structural properties.

The hot forming process is a third technique for producing high density ferrous P/M parts. In the hot forming process, the starting powder is first molded and sintered, usually at around 40 tsi and 2050° F. The part is then reheated to forging temperatures in the 1500–1800° F. range, placed in a heated die, and hot formed at 50–60 tsi to a high density. Again, for optimum properties, the part is heat treated in additional operation. Densities by the hot forming process can approach theoretical maximum density, 7.80–7.85 g/cc. These density values may be compared with iron's 7.87 g/cc theoretical maximum density.

Each of the above processes has disadvantages. The mold-sinter process does not produce densities sufficient for structural parts subjected to high stresses. In addition, in the absence of carbon, parts produced by a pure iron powder mold-sinter technique have relatively low strength and surface hardness and are, therefore, unsuited for applications where they are subjected to high cyclic stresses.

Relative to a mold-sinter technique, the double press/double sinter process provides a higher density part, but the process is quite expensive because it requires two dies, two pressings and two furnace operations. The cost of dies is a major portion of the cost in manufacturing P/M parts. Any additional heat treatment employed after the second sinter step necessarily adds the expense of a third furnace operation.

The hot forming process provides the highest currently attainable densities for ferrous P/M parts. However, size control is difficult during the hot forming process. Size control is particularly important in the manufacture of structural parts, which may require exacting tolerances. The hot forming process is also relatively expensive because it includes two furnace operations and the use of a heated die during the hot forming operation. Typically one to ten million tools may be produced from a single pressing die in P/M processing. However, the heated forming dies used in the hot forming process must be replaced after only about 50,000 hot forming cycles, substantially increasing the cost of the finished part.

As discussed above, P/M parts produced by the above three techniques are normally subjected to separate final heat treatments to maximize the parts' structural properties. In a typical heat treatment, a finished part is heated to 1400°–1600° F. and then oil quenched. The resulting hard and brittle part is tempered at 300°–600° F. to impart toughness without significant reduction in part hardness or strength. In both the double press/double sinter and hot forming processes 0.3–1.0 weight percent carbon powder is added to the initial powder mix to increase the strength and surface hardness of the finished part and to optimize the results of the subsequent heat treatments. The carbon content is slightly diminished to between 0.3–0.8 weight percent after carbon loss from furnace operations.

Although carbon powder must be added to optimize structural properties produced by heat treatment, the free carbon in the pre-compacted powder reduces the compressibility of the powder and, therefore, reduces the both the maximum density and the fatigue resistance of the finished part. Therefore, although it is known to use carbon powder-free materials in P/M processing to maximize density, methods for producing structural parts wherein the initial powder mix is devoid of powdered carbon are not widely practiced because optimum strength, hardness and fatigue properties may not be achieved.

U.S. Pat. No. 2,489,839, entitled "Process for Carburizing Compacted Iron Articles" and referred to herein as the '839 patent, does provides a method for producing ferrous P/M parts from an initial powder substantially free of carbon powder. The '839 patent discloses a multiple sinter/repress process for producing ferrous P/M parts having a substantially uniform carbon content. The '839 process' starting material is preferably a pure electrolytic iron powder which may contain desired amounts of powdered metal alloying ingredients and which is substantially free of carbon. The initial powder mix of the '839 patent is compacted at less than 40 tsi, sintered and then repressed at or above 60 tsi. To provide the compact with a uniform carbon content, the repressed compact is preferably treated in a two-step process consisting of (i) an initial carburizing step at 1600°–2000° F. to produce a high carbon outer layer and (ii) a carbon homogenization step wherein the carbon in the high-carbon layer is redistributed throughout the compact.

The homogenization step of the '839 patent is carried out by heating the compact for an extended period in a controlled environment having a carbon concentration chosen to provide a desired carbon concentration throughout the steel compact. The homogenization step is intended to uniformly distribute the carbon throughout the iron part, rather than concentrate the carbon near the surface of the part. Migration of the carbon from the outer layer to the interior of the compact during the homogenization step necessarily reduces the carbon level in the surface of the part which in turn lowers hardness and rolling contact fatigue properties.

Considering the disadvantages of the above processes, an objective of the present invention is to provide a process for manufacturing P/M parts having high density, high surface hardness and superior rolling contact fatigue properties.

A further object of the invention is to produce a high density P/M part having high surface hardness and superior rolling contact fatigue properties with a minimum number of pressing, sintering and heat treating operations.

SUMMARY OF THE INVENTION

To satisfy the above-stated objectives, the present invention provides a process for producing ferrous P/M parts having high density, high surface hardness, and superior rolling contact fatigue resistance. The process is referred to herein as the "HFA process". The HFA process includes the steps of:

(a) Compacting a portion of an initial powder, which consists of high purity iron and/or high purity iron alloy powder and is substantially free of graphite, at room temperature and at about 40–50 tsi to provide a green compact;

(b) Heating the green compact in an inert, non-oxidizing environment at a temperature in the range of about 2050°–2300° F. to provide a sintered compact;

(c) Repressing the sintered compact at room temperature at approximately 60 tsi to provide a repressed compact;

(d) Carburizing the repressed compact at high temperature to form a skin of relatively high carbon concentration to a depth of at least 0.010 inches, and preferably to a depth between 0.020 to 0.040 inches, on the compact;

(e) Quenching the carburized compact, preferably in oil, from 1400°–1600° F. as it cools from the carburizing temperature to provide a quenched compact and then tempering the quenched compact, preferably at about 325°–500° F. to provide a tempered compact.

The present invention also provides three extrusion processes to produce ferrous P/M parts having high surface hardness, and superior rolling contact fatigue resistance. The three extrusion processes are referred to herein as the HFA/Extrusion processes (in contrast to the HFA process) because the three processes incorporate certain steps of the HFA process and an additional extrusion step. The three HFA/Extrusion processes provide parts which, in general, have lower overall densities than parts produced by the HFA process. However, the extrusion processes provide the parts with high densities in their outer surface regions. Each of the three extrusion processes includes the compacting and heating steps of the above HFA process plus the following additional steps.

In a first HFA/Extrusion process of the present invention, after the compacting and heating steps of the HFA process, the sintered compact is extruded through a die to obtain a reduction in diameter of about 2–6%, and then the extruded compact is carburized at high temperature to provide the compact with a high carbon skin to a depth of at least 0.010 inches, and preferably to a depth of between about 0.020 to about 0.040 inches. The heated carburized compact is then immediately quenched and tempered to provide desired mechanical properties.

In a second HFA/Extrusion process of the present invention, a P/M material is processed as in the compacting, heating and repressing steps of the HFA process. The repressed compact is then extruded through a die for a diameter reduction of about 2–6% to provide an extruded compact. The extruded compact is then carburized, quenched and tempered as in the first extrusion process.

In a third HFA/Extrusion process of the present invention, P/M material is processed using the compacting, heating and extrusion steps of the first HFA/Extrusion process. The extruded compact is then repressed, carburized, quenched and tempered as in steps (c), (d) and (e) listed above for the HFA process.

As discussed in the following detailed description of the invention, the HFA process and the three extrusion processes of the present invention provide a P/M material having high densities higher than material produced by the mold-sinter method and at least comparable to material produced by the double press/double sinter method. The combined carburization/quench/temper treatment provides parts with surface hardness and rolling contact fatigue properties which exceed those of parts produced by the mold-sinter and double press/double sinter methods, as well as the method of the '839 patent.

DESCRIPTION OF THE PREFERRED EMBODIMENTS

Figure 1:
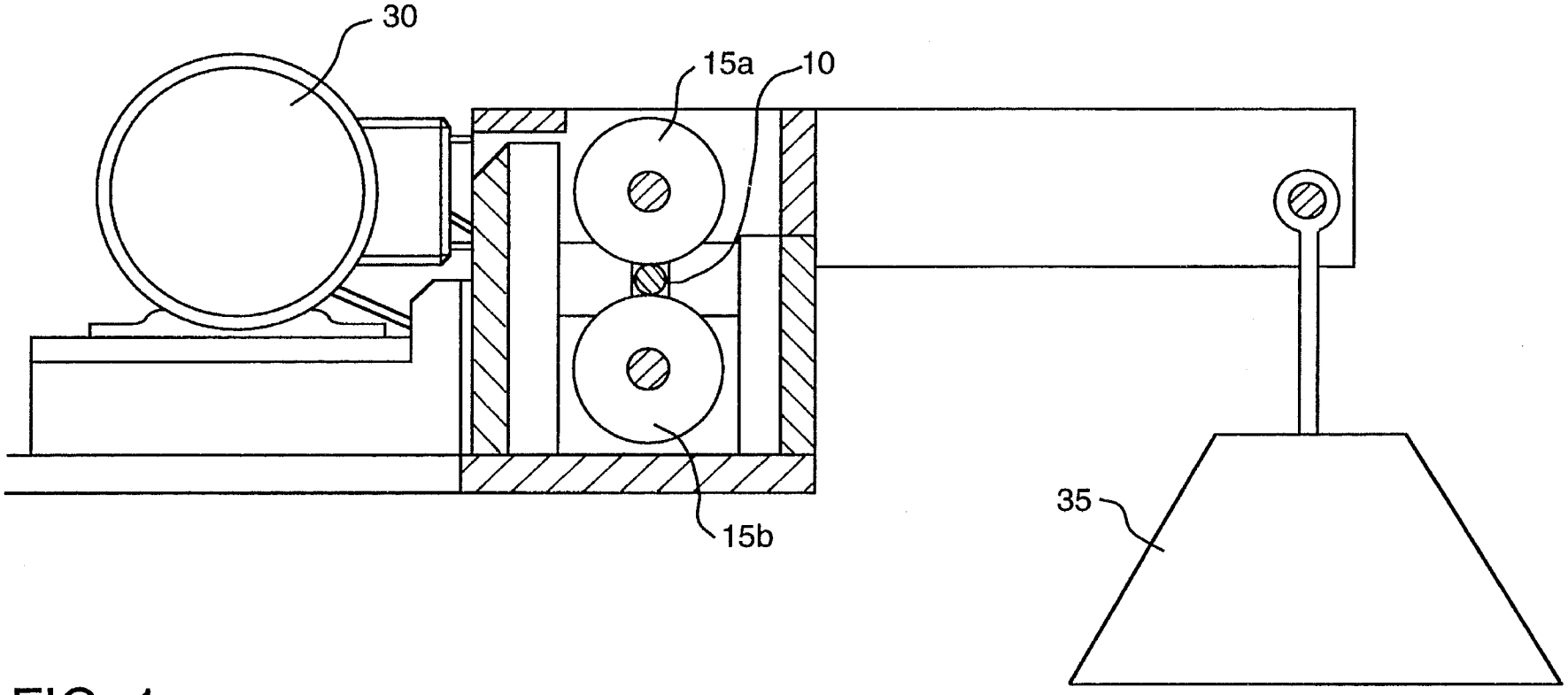
FIG. 1 is a schematic partial cut-away view of the A-type apparatus used to determine rolling contact fatigue properties of samples of the HFA material produced by the process of the present invention and samples of material produced by the mold-sinter process, the double press/double sinter process, and the process of U.S. Pat. No. 2,489,839.

The process of the present invention, referred to herein as the "High Fatigue Alloy" or "HFA" process, includes the first step of compacting at about 40 to about 50 tsi, preferably at 50 tsi, and at room temperature an initial powder consisting of highly compressible, high purity atomized iron powder and/or one or more high purity powders of atomized iron alloys. For purposes of this specification, "high purity" iron and iron alloy powders are defined as those typically include among their impurities the following maximum contents: 0.02 weight percent carbon, 0.15 weight percent oxygen, and 0.025 weight percent sulfur.

The initial powder must not include any free carbon additive, such as, for example, graphite. To maximize its compressibility, it is also preferred that the initial powder not contain any carbon-containing alloy powders. The preferred initial powder is a high purity iron-molybdenum powder containing about 0.8–1.5 weight percent molybdenum, balance iron. Typical commercially available iron-molybdenum powders meeting these requirements are the 85 HP and 150 HP powders available from Hoeganaes (an Interlake Company), Riverton, N.J., and 4401 powder available from Quebec Metal Powders, Montreal, Canada. Both the 85 HP and 150 HP powders have typical impurities of less than 0.01 weight percent carbon, 0.14 weight percent manganese and 0.07 weight percent oxygen. The 4401 powder has typical levels of 0.003 weight percent carbon, 0.08 weight percent oxygen, 0.15 weight percent manganese, 0.07 weight percent nickel, 0.007 weight percent sulfur, and 0.01 weight percent phosphorous.

Less preferred than the iron-molybdenum powders are the iron-nickel-molybdenum powder grades. As nickel content increases, compressibility decreases. The iron-molybdenum powders are, therefore, preferred over the iron-nickel-molybdenum powders if maximum densities are desired.

Preferred iron-nickel-molybdenum powders include A2000 powder available from Hoeganaes and 4201 powder available from Quebec Metal Powders. Each of those two powders contains approximately 0.5 weight percent nickel, 0.6 weight percent molybdenum, and balance iron. Less preferred iron-nickel-molybdenum powders are Hoeganaes' 4600 powder and Quebec Metal Powder's 4601 powders, which contain approximately 1.8 weight percent nickel, 0.6 weight percent molybdenum, and balance iron. It is preferred that powders of about –80 mesh be used in the HFA process of the present invention.

The green compacts exhibit typical densities of about 7.15–7.25 g/cc. It is preferred that the green compacts have densities of 7.15 g/cc or greater. It has been found that if the pressure is reduced below about 40 tsi, unacceptable green compact densities of less than approximately 7.00 g/cc result.

In step two, the green compact is sintered in an inert, non-oxidizing environment, preferably a nitrogen/hydrogen, hydrogen or vacuum environment, at about 2050°–2300° F. (The nitrogen/hydrogen sintering environment is composed of approximately 90 parts by volume nitrogen gas and 10 parts by volume hydrogen gas.) A sinter of about 30–60 minutes at a temperature of 2080°–2300° is preferred. Higher sinter temperatures may provide some advantage where impact properties are important, but it has been found that HFA compacts sintered at 2080° F. have predicted rolling contact fatigue limits equal to those sintered at 2300° F. The sintered compact is substantially free of carbon and, therefore, has unacceptably low strength and impact properties for structural applications.

In step three, the sintered compact is placed in the die used in the first step and is sized at about 55–65 ksi and at room temperature. Sizing may also be referred to in the present application as repressing or coining. The sized compact has a significantly increased density of about 7.55–7.68 g/cc. The increased density is due to the lack of carbon in solution in the sintered compact and the resulting low hardness and high deformability of the sintered compact.

In step four, the sized compact is carburized in a carbon-containing atmosphere at least about 1600° F. for a period of time sufficient to produce a high carbon skin to a depth of at least 0.010 inches, and preferably to a depth between 0.020–0.040 inches, around the part. Depending on the desired thickness of the high-carbon layer, the carburizing cycle may be varied in the temperature range of about 1600°–1750° F. and for two to five hours. The carburization step is intended to concentrate the introduced carbon in a well defined high carbon case around the part.

A variety of methods for producing the desired carbon case will be known to those skilled in the art. The carbon case thickness produced by the carburization step will increase with increasing duration, increasing temperature and increasing carbon potential in the atmosphere surrounding the part. As part density decreases, it becomes easier for the carburizing gas to penetrate the porous part and a deeper case results. Composition of the base iron alloy can also influence carbon case depth. For example, if strong carbide forming elements, such as, for example, chromium, are added to the base alloy, the carbide former will absorb carbon more readily and case depth will increase. Likewise, if a high carbon tool steel powder is added to the base iron in the compact, carbon will be found deeper in the part. When additional alloy elements or harder powders, such as, for example tool steel powders, are added to the base high purity iron powder, the compacts cannot be molded or sized to as high a density as pure iron powder grades. The resulting lower densities increase compact porosity, making it easier for the carburizing gas to penetrate the compact.

For purposes of this specification, carbon potential has the definition provided in the 1985 Metals Handbook where it is defined as "a measure of the ability of an environment containing active carbon to alter or maintain, under prescribed conditions, the carbon level of [a]steel." In any particular environment, the actual carbon level attained in the steel will depend on such factors as temperature, time and steel composition. In general, if a steel having a carbon level of 0.6% is placed into an atmosphere with a 0.6% carbon potential, the steel should neither lose carbon (decarburize) or gain carbon (carburize). If the carbon potential is greater than the steel's carbon content, the steel will tend to gain carbon. If the carbon potential is lower than the steel's carbon content, the steel will tend to lose carbon.

In step five, the still hot carburized part is quenched on removal from the carburizing apparatus to bring its temperature close to room temperature, preferably in an oil bath. The quenched compact is then tempered at about 300°–500° F., preferably at about 350°–400° F., for approximately 30–60 minutes at temperature. The parameters of the tempering step necessary to provide optimum strength, surface hardness and toughness properties are not very dependent on the powder composition used to make the parts. The tempering operation is normally a batch operation wherein a basket of parts is placed in a furnace. Because the compact is immediately subjected to quenching and tempering on removal from the carburizing apparatus, the HFA process consolidates the carburizing operation with the heat treatment to provide a combined carburization/heat treatment step.

The preferred carburization/quench/temper cycle for the HFA process is as follows: (1) heat the compact from room temperature to 400° F. in endogas in about one hour; (2) increase the carbon potential in the atmosphere to 0.9–1.1% carbon and increase the temperature to 1750° F.; (3) hold the compact at 1750° F. for 1.25 hours; (4) cool the compact to 1600° F. and adjust the carbon potential to 0.7–0.8% carbon; (5) hold at 1600° F. for 2.5 hours; (6) cool to 1500° F. and oil quench; and (7) temper the quenched compact for 60 minutes at 400° F. (This seven-step procedure will be referred to herein as the preferred carburization/quench/temper procedure for the HFA process.) The carbon level at the surface of compacts treated by this seven-step cycle is approximately 0.8%. Disks of HFA material 1.0 inch in diameter and 0.120 inches thick treated by the above cycle were found to have a distinct carbon case 0.030 inches thick after the carburizing step. Endogas refers to the product of the combustion of a controlled mixture of air and natural gas. The nominal composition of an endogas atmosphere is 40 parts by volume hydrogen, 40 parts by volume nitrogen, 10 parts by volume carbon monoxide, with a trace of several other gases.

P/M parts produced by the HFA process, referred to herein as "HFA parts", include a high carbon surface layer to increase surface hardness and optimize wear resistance and fatigue resistance, but also include a low carbon core to allow maximum part density. HFA parts heat treated as described above have the following typical properties: 7.55–7.65 g/cc density; Rockwell C hardness of about 50–58; Modulus of Rupture of about 200–240 ksi (thousand pounds per square inch); and an impact strength of 2.5–3.5 ft-lbs measured on a standard rupture bar of 1.250"×0.500"×0.200".

Addition of Carbon-Containing and/or Chromium-Containing Powders in the HFA Process As a modification to the HFA process of the present invention, one or more carbon-containing or chromium-containing powder components can be added to the initial powder mix to provide desired properties in the final P/M part. Examples of these additives include high speed tool steel powders (also referred to herein as "HSS") and stainless steel powders.

The stainless steel powders are added to the base iron powders in the HFA process to introduce chromium into the compacts. Chromium is a strong carbide former and will attract carbon to form hard carbide particles in the final compositions. These carbides can be beneficial because they increase part wear resistance without compromising rolling contact fatigue properties. Further, it has been found that the addition of stainless steel powders to introduce chromium does not drastically reduce compressibilities, although final part densities do decrease approximately 0.05–0.15 g/cc. Preferred stainless steel powders are those of the AISI type 400 series. For example, 10–20 weight percent of AISI type 410 stainless steel powder has been included in an initial powder to incorporate chromium in the final part. A final part density of 7.50–7.55 g/cc was achieved. Additions of powders of the AISI type 300 stainless steel series are less preferred because their significant amounts of nickel can reduce the compressibility of the sintered compacts.

The high speed steel powders contribute hardness and wear resistance without significantly decreasing fatigue properties of finished parts. HSS powders have relatively high carbon contents, but the carbon is tied up as relatively stable carbides. Densities achieved with HSS powder additions are somewhat lower than with pure iron powder because HSS powders are somewhat less compressible. Additions of HSS in the present HFA process are limited to about 20 weight percent maximum because the HSS tends to reduce the density of HFA material if added in greater amounts. Suitable HSS powders include M2, low carbon M2, M3/2, M4 and T15. Other carbon-containing powders useful in the HFA process include low carbon iron-chromium, iron-manganese and iron-vanadium powders, and some carbides such as, for example titanium carbide. In most cases, only low level additions of the carbon-containing powders would be used because of their adverse effect on sized and molded densities. Any carbon-containing powder component added must include carbon only in a totally alloyed form to maintain good compressibility of the powder, although a slight reduction in final density is to be expected. It is believed that compressibility is not significantly affected by such additions because any alloyed carbon will be retained in alloyed form and will not migrate into the iron matrix as free carbon. For example, it has been found that up to 20% of a high carbon alloy powder such as, for example, M2 high speed tool steel powder (nominal chemistry in weight percentages: 0.85 carbon-4.0 chromium-5.0 molybdenum-6.2 tungsten-2.0 vanadium-balance iron) can be incorporated into the powder mix without a significant reduction in the final density of the P/M part, its surface hardness, or rolling contact fatigue properties.

In a more specific example, a powder mix of 15 weight percent low carbon, modified M2 tool steel powder (Grade H100G available from Powdrex Ltd., Tonbridge, Kent, England, and 85 weight percent iron-molybdenum powder (85 HP Grade available from Hoeganaes) was molded at 50 tsi and then sintered for 30 minutes at 2300° F. The Hoeganaes grade H100G M2 tool steel powder had the nominal chemistry (in weight percentages) of 0.4 carbon, 3.9 chromium, 2.5 molybdenum, 3.2 tungsten, 1.9 vanadium, and balance iron. The sintered compact was sized at 60 tsi to a density of 7.45–7.55 g/cc. The sized-compact was then treated by the preferred carburize/quench/temper cycle detailed above. A final density of 7.40–7.50 g/cc resulted. It is believed that the part processed in this manner has significantly increased wear resistance because of the fine M2 tool steel powder dispersed throughout the low alloy steel matrix. It is believed that carbon in the M2 tool steel powder is so tightly bound to the carbide forming elements in the tool steel that very little carbon diffuses into the low alloy matrix, even at 2300° F. Therefore, the compact retains very good compressibility and can attain the densities characteristic of HFA alloys without tool steel powder.

Comparison of the Mold-Sinter, Double Press/Double Sinter, Hot Forming and HFA Processes Compared with the mold-sinter, double press/double sinter, and hot forming processes, the HFA process provides the most desirable properties at a relatively low cost. The mold-sinter process produces parts with lower structural properties than the double press/double sinter, hot forming, and HFA processes, and requires a separate heat treatment step. The HFA process includes fewer production steps and is less costly than the double press/double sinter, which requires second press and sinter steps as well as a separate heat treatment operation. Yet the HFA process yields significantly increased densities relative to the double press/double sinter method. In addition, if parts produced by the HFA process are properly heat treated, parts subjected to cyclic rolling stresses have lifetimes ten times longer than those measured for heat treated parts produced by the mold-sinter process and, on average, 1.5–3 times longer than parts produced by the significantly more expensive double press/double sinter method. Considering rolling contact fatigue limits for the various methods, heat treated mold-sinter material exhibits values in the 160–185 ksi range, double press/double sinter material exhibits values of about 200–230 ksi, and material produced by the present HFA process exhibits limits in the 220–275 ksi range. For purposes of this specification, the predicted rolling contact fatigue limit is a theoretical value which is the maximum cyclic rolling contact stress which can be applied to a rolling sample of the material which never results in sample failure. Although the hot forming method provides excellent part densities, it is also quite expensive relative to the HFA process, primarily due to tooling costs, and allows only fair dimensional control of parts during manufacture.

P/M parts produced by the mold-sinter, the double press/double sinter, and the present invention's HFA processes were evaluated for density, surface hardness, and resistance to rolling contact fatigue. The results are recorded in Table 1 below. Samples 1–7 listed in Table 1 were produced as follows. Each of the stated amounts of impurities in the powder ingredients are given in weight percentages.

SAMPLE 1

A powder mix of 95 parts (by weight unless otherwise specified) atomized iron powder (Hoeganaes grade 1000B), 5 parts nickel powder (grade 287 nickel powder available from Inco, Wyckoff, N.J., having maximum impurities of less than 0.25 carbon, less than 0.15 oxygen, less than 0.01 iron, and less than 0.001 sulfur), 0.6 parts graphite powder (grade 1652 graphite available from Southwestern Graphite, Burnet, Tex., having maximum 5% ash), and 0.75 parts bis-stearamide lubricant (available under the trade name Acrawax from Lonza, Fairlawn, N.J., and having less than 0.05% ash) was prepared by blending the ingredients in a conical blender for 30 minutes. The powder mix was compacted at 50 tsi at room temperature, and the green compact was then sintered at 2080° F. for 30 minutes in an atmosphere of 90 parts by volume nitrogen gas and 10 parts by volume hydrogen gas. The sintered compact was then cooled to room temperature. After cooling, the compact was reheated to 1500° F. (30 minutes at temperature) and quenched in oil. The quenched part was then tempered at 400° F. for 60 minutes at temperature.

SAMPLE 2

A powder mix of 98 parts Hoeganaes grade 1000B atomized iron powder, 2 parts Inco grade 287 nickel powder, 0.6 parts Southwestern Graphite grade 1652 graphite powder, and 0.75 parts Acrawax bis stearamide lubricant was prepared by blending the ingredients in a conical blender for 60 minutes. The powder mix was compacted at 50 tsi at room temperature, and the green compact was then sintered at 2080° F. for 30 minutes in an atmosphere of 90 parts by volume nitrogen gas and 10 parts by volume hydrogen gas. The sintered compact was then cooled to room temperature, reheated to 1500° F. (30 minutes at temperature), and quenched in oil. The quenched part was then tempered at 400° F. for 60 minutes at temperature.

SAMPLE 3

96.5 parts iron alloy powder (Hoeganaes grade A2000 containing approximately 0.5 weight percent nickel, 0.6 weight percent molybdenum, balance iron), was mixed with 1.5 parts Inco grade 287 nickel powder, 0.6 weight percent Southwestern Graphite grade 1652 graphite powder, and 0.75 parts Acrawax bis-stearamide lubricant using a conical blender. The powder mix was compacted at 50 tsi at room temperature, and the green compact was then sintered at 2080° F. for 60 minutes in an atmosphere of 90 parts nitrogen gas and 10 part hydrogen gas. The sintered compact was then cooled to room temperature, reheated to 1500° F. (30 minutes at temperature), and quenched in oil. The quenched part was then tempered at 400° F. for 60 minutes at temperature.

SAMPLE 4

A powder mix having the composition used in Sample 1 was compacted at 50 tsi at room temperature and the green compact was then pre-sintered at 1550° F. for 30 minutes in an atmosphere of 90 parts nitrogen gas and 10 parts hydrogen gas. The sintered compact was then sized at room temperature and 60 tsi and the sized compact was then sintered at 2080° F. for 30 minutes in an atmosphere of 90 parts nitrogen gas and 10 parts hydrogen gas. The sintered compact was cooled to room temperature, reheated to 1500° F. (30 minutes at temperature), and then quenched in oil. The quenched part was then tempered at 400° F. for 60 minutes at temperature.

SAMPLE 5

A powder mix having the composition of the mix of Sample 2 was used to prepare a P/M part by the process employed in Sample 4 above.

SAMPLE 6

A powder mix having the composition of mix of Sample 3 was used to prepare a P/M part by the process employed in Sample 4 above.

SAMPLE 7

A powder mix of 100 parts Hoeganaes grade 85 HP iron-molybdenum powder (0.85 weight percent molybdenum, balance iron and impurities) and 0.65 parts atomized Acrawax bis-stearamide lubricant was prepared by blending for 30 minutes in a conical blender. The powder mix was then processed to a P/M material by the HFA process of the present invention. The powder mix was compacted at 50 tsi at room temperature, and the green compact was then sintered at 2080° F. for 30 minutes in an atmosphere of 90 parts nitrogen gas and 10 parts hydrogen gas. The sintered compact was then sized at room temperature and 60 tsi. The sized compact then carburized using the preferred carburization/quench/temper cycle provided above for the HFA process.

TABLE 1

PROCESSING AND DATA FOR SAMPLES 1–7

| Sample | Powder Composition | Process | Density (g/cc) | Hardness ($R_c$) | Thousand Cycles To Failure at: 350 ksi | 400 ksi | 450 ksi |
|---|---|---|---|---|---|---|---|
| 1 | 95Fe—5Ni—0.6C | Mold-Sinter-Q&T @ 400° F. | 6.9 | 41 | 464 | 300 | 130 |
| 2 | 98Fe—2Ni—0.6C | Mold-Sinter-Q&T @ 400° F. | 6.9 | 43 | 330 | 145 | 140 |
| 3 | 98Fe—2Ni—0.5Mo—0.6C | Mold-Sinter-Q&T @ 400° F. | 6.9 | 43 | 289 | 118 | 100 |
| 4 | 95Fe—5Ni—0.6C | DP/DS-Q&T @ 400° F. | 7.4–7.5 | 48 | 5500 | 1900 | 890 |
| 5 | 98Fe—2Ni—0.6C | DP/DS-Q&T @ 400° F. | 7.4–7.5 | 49 | 3500 | 1100 | 620 |
| 6 | 98Fe—2Ni—0.5Mo—0.6C | DP/DS-Q&T @ 400° F. | 7.4–7.5 | 50 | 2900 | 357 | 177 |
| 7 | HP85 | HFA-Q&T @ 400° F. | 7.5–7.6 | 55 | — | 11900 | 1700 |

The hardness values listed in Table 1 are Rockwell C hardness values measured using a diamond-tipped microhardness tester. Rolling contact fatigue values were determined using the rolling contact fatigue testing machine depicted in FIG. 1 which was designed by Keystone Carbon Company, St. Marys, Pa. The test specimen 10 is a cylinder of 0.562 inches in diameter and 0.625 inches in length which is disposed between the perimeter surfaces of bearing-mounted hard tool steel rollers 15*a* and 15*b*. Lubricating oil is dripped onto the contacting surfaces of the rollers 15*a* and 15*b*. Rollers 15*a* and 15*b* are driven to rotate at 1750 rpm in the same direction by motor 30 and achieve approximately 1.1 million cycles per hour, thereby causing the specimen 10 to rotate in the opposite direction. The rollers 15*a* and 15*b* apply rolling pressure to test specimen 10 by weight 35 which biases one roller toward the other.

The rolling contact fatigue values given in Table 1 are the number of revolutions of the test specimen before failure. Failure is defined as the loss of material from the specimen surface by spalling, peeling or substantial pitting. As indicated in Table 1, values for rolling contact fatigue were determined by applying stresses of either 350, 400, or 450 ksi onto the rolling surface of the test specimen.

The data in Table 1 shows that the HFA process produces a part having densities significantly greater than the mold-sinter process and at least comparable to parts produced by the double press/double sinter method. Rockwell C hardness values for the HFA parts (sample 7) are significantly greater than parts produced by either the mold-sinter or the double press/double sinter method. The density and hardness properties of the HFA material provide rolling contact fatigue lifetimes in this test which are more than double the highest non-HFA value at 450 ksi (sample 4), and more than six times greater than the highest non-HFA value at 400 ksi (also sample 4). Although rolling contact fatigue values were not determined for the HFA sample (sample 7) at 350 ksi, the 11,900 cycle value obtained for the HFA material at 400 ksi is more than double that for sample 4 at 350 ksi.

Additional tests to determine predicted rolling contact fatigue limits for three different P/M materials were conducted on both the apparatus described above, referred to hereafter as the "A-type" apparatus, and on a similarly constructed apparatus referred to herein as the "B-type" apparatus. The B-type apparatus used a cylindrical specimen of approximately 0.452 inches outside diameter, 0.157 inches inside diameter, and 0.590 inches long. Heated oil (250°–300° F.) was sprayed onto the specimen surface. The drive rolls of the apparatus were run at a nominal speed of 1400 rpm to achieve approximately 930,000 cycles per hour. The B-type apparatus provided a cyclic compressive stress on the cylindrical test sample of between 350–400 ksi. The three samples (samples 8–10) were produced as follows.

SAMPLE 8

A powder mix of 100 parts Hoeganaes grade 85 HP iron-molybdenum powder, 2 parts Inco grade 123 nickel powder (having typical impurities (weight percentages) of less than 0.1 carbon, less than 0.15 oxygen, less than 0.01 iron, and less than 0.001 sulfur), 0.8 parts Southwestern Graphite grade 1652 graphite, and 7.5 parts Powdrex grade H100G M2 high speed tool steel powder was prepared by blending for 30 minutes in a conical blender. The powder mix was compacted at 50 tsi at room temperature, and the green compact was then sintered at 2300° F. for 30 minutes in an atmosphere of 90 parts nitrogen gas and 10 parts hydrogen gas. The sintered compact was then cooled to room temperature, reheated to 1500° F. (30 minutes at temperature), and quenched in oil. The quenched part was then tempered at 400° F. for 60 minutes at temperature.

SAMPLE 9

98 parts Hoeganaes grade HP85 iron-molybdenum powder, 2 parts Inco grade 123 nickel powder, and 0.65 parts Acrawax atomized bis-stearamide lubricant was prepared by blending for thirty minutes in a conical blender. The powder mix was compacted at 50 tsi at room temperature, and the green compact was then sintered at 2300° F. for 60 minutes in an atmosphere of 90 parts nitrogen gas and 10 parts hydrogen gas. The sintered compact was then sized at room temperature and 60 tsi. The sized compact then subjected to the HFA process' preferred carburization/quench/temper procedure set out above.

SAMPLE 10

A mixture of 98 parts Hoeganaes grade 85 HP iron-molybdenum powder, 2 parts Inco grade 123 nickel powder, 15 parts Powdrex H100G M2 steel powder, and 0.6 parts Acrawax bis-stearamide lubricant was prepared by blending the ingredients in a conical blender for 30 minutes. The powder mix was compacted at 50 tsi at room temperature, and the green compact was then sintered at 2300° F. for 30 minutes in an atmosphere of 90 parts nitrogen gas and 10 parts hydrogen gas. The sintered compact was then sized at room temperature and at 60 tsi. The sized compact then subjected to the preferred carburization/quench/temper cycle of the HFA process set out above Results of the testing of samples 8–10 are provided in Table 2. The reported fatigue values take into account the expected variation in the Youngs Modulus for the samples resulting from unavoidable part density variations. Values calculated from data obtained on A-type equipment are annotated "(A)", while values derived from data using B-type equipment are annotated "(B)". Although samples 9 and 10 were prepared with 2.0 weight percent nickel powder, it was determined after additional research that a nickel addition is not helpful to produce desirable rolling contact fatigue properties and actually reduces part density when used in the HFA process.

As shown by Table 2, the results derived from the two testing apparatuses provided comparable values and confirmed the accuracy of the reported values. It is believed, however, that the higher rolling contact fatigue limit values calculated using data from the B-type apparatus are somewhat more accurate because they were calculated from three-fold as many data points. The results of Table 2 verify the greatly enhanced rolling contact fatigue properties of the present invention's HFA material relative to material produced by the mold-sinter process. Predicted fatigue limits were significantly higher for the HFA material and the predicted cycles at 300 ksi for the HFA material were as much as thirty times greater than predicted values for the mold-sinter material.

Comparison of the HFA Process and the Process of the '839 Patent

The HFA process of the present invention also has advantages over the process disclosed in the '839 patent. The process of the '839 patent, which includes a carbon homogenization treatment, is fundamentally different from the HFA process. The '839 patent's homogenization treatment is intended to uniformly distribute carbon throughout the iron part to provide a homogenous high density steel composition. To do this, the '839 patent resorts to long duration, high temperature thermal cycles to equally distribute carbon through the parts. In contrast to '839 patent, the objective of the present HFA process is to concentrate carbon near the surface of the part to promote fatigue properties and provide superior surface hardness and rolling contact fatigue properties, while allowing high compressibility and part density. Distribution of carbon throughout the part is not required for the HFA process. It has been found that carbon will only penetrate throughout the part using the carburization step

TABLE 2

PROCESSING AND DATA FOR SAMPLES 8–10

| Sample | Powder Composition | Process | Predicted Rolling Contact Fatigue Limit | Predicted Million Cycles @ 300 ksi |
|---|---|---|---|---|
| 8 | HP85—2Ni—0.8C—7.5HSS | Mold-Sinter-QT | 167 (A)<br>177 (B) | 1.15 (A)<br>1.89 (B) |
| 9 | HP85—2Ni | HFA | 235 (A)<br>248 (B) | 37.8 (A)<br>23.5 (B) |
| 10 | HP85—2Ni—15HSS | HFA | 203 (A)<br>228 (B) | 17.7 (A)<br>6.2 (B) |

As indicated in Table 2, each P/M material of samples 8–10 was tested using both A-type and B-type equipment. The object of the testing was to calculate predicted rolling contact fatigue limits and the predicted number of cycles to failure for a sample subjected to a cyclic rolling contact stress of 300 ksi. The predicted fatigue limit is a theoretical value which is the maximum cyclic rolling contact stress which can be applied to a rolling sample of a material which never results in a sample failure. It is predicted that the HFA material of sample 10 could indefinitely withstand a cyclic rolling contact stress of between 203 ksi (A-type apparatus) and 228 ksi (B-type apparatus), while the HFA material of sample 9 could indefinitely withstand a cyclic rolling contact stress of between 235 ksi (A-type testing equipment) and 248 ksi (B-type testing equipment).

parameters of the HFA process if the part has unacceptably low density. Also, when P/M material is prepared as described in the '839 patent so that carbon is uniformly distributed throughout the part, the material exhibits poor rolling contact fatigue properties.

Experimental samples 11–20 were prepared as follows. Density, hardness (Rockwell B or C, as indicated), and predicted rolling contact fatigue limits for the samples are provided in Table 3.

SAMPLE 11

A powder mix of 100 parts Hoeganaes grade HP85 iron-molybdenum powder and 0.65 parts atomized Acrawax bis-stearamide atomized lubricant was prepared by blending in a conical blender for 30 minutes. The powder mix was then processed to a P/M material by the HFA process of the present invention. The powder mix was compacted at 50 tsi at room temperature, and the green compact was then sintered at 2080° F. for 30 minutes in a nitrogen/hydrogen gas atmosphere. The sintered compact was then sized at room temperature and 60 tsi. The sized compact was then subjected to the preferred carburization/quench/temper cycle of the HFA process set out above.

SAMPLE 12

A powder mix of 93 parts Hoeganaes grade HP85 iron-molybdenum powder, 7 parts AISI type 410L stainless steel powder, and 0.65 parts atomized Acrawax bis-stearamide lubricant was prepared as in Sample 11. The stainless steel powder was available from SCM, Research Triangle Park, N.C. and was added to provide chromium to the powder mix. The powder was then processed to a P/M material by the HFA process using the same steps employed for the powder of mix of Sample 11.

SAMPLE 13

A powder mix of 100 parts electrolytic iron powder and 0.65 parts stearic acid lubricant was prepared by blending for 30 minutes in a conical blender. A P/M material was then prepared from the powder mix using the process of the '839 patent as follows. The powder mix was molded at 50 tsi at room temperature and the green compact was then sintered in a nitrogen/hydrogen gas environment at 2080° F. for 30 minutes. The sintered compact was then sized at room temperature at 60 tsi. The sized compact was then carburized using only the carburization portion (steps 1–5) of the HFA process' preferred carburization/quench/temper cycle. The carbon in the carburized compact was then diffused and homogenized throughout the compact by placing the compact in a vacuum for 6 hours at 1800° F. The homogenized part was then withdrawn to a cooling chamber while maintaining vacuum and was cooled to room temperature in circulating nitrogen gas.

SAMPLE 14

The P/M material sample was prepared by the method of the '839 patent using process steps identical to those used to prepare Sample 13, but a sintering temperature of 2300° was used.

SAMPLE 15

A powder mix of 97 parts electrolytic iron powder, 3 parts low carbon ferrochrome powder milled to –325 mesh (containing impurities (in weight percentages) of less than 0.1 carbon, 1.1 silicon, 0.02 sulfur, and 0.03 phosphorus), and 0.65 parts stearic acid was prepared according to the procedure of Sample 13. The powder mix was then processed to a P/M material by the '839 patent's method using the process steps used to prepare Sample 13.

SAMPLE 16

A powder mix was prepared as in Sample 15. The powder mix was then processed to a P/M material by the method of the '839 patent using to prepare Sample 14.

TABLE 3

PROPERTIES OF HFA MATERIAL V. MATERIAL PRODUCED BY THE '839 PATENT'S PROCESS

| Sample No. (Grade) | Process | Sinter Temp. (°F.) | Re-press (tsi) | Den-sity (g/cc) | Rock-well Hard-ness | Predic-ted Fatigue Limit (ksi) |
|---|---|---|---|---|---|---|
| 11 | HFA, CQT | 2080 | 60 | 7.58 | C46 | 220–276 |
| 12 | HFAw/Cr, CQT | 2080 | 60 | 7.61 | C50 | 263–271 |
| 13 | '839, Homog. | 2080 | 60 | 7.59 | B53 | 139 |
| 14 | 839, Homog. | 2300 | 60 | 7.57 | B55 | 119 |
| 15 | '839w/Cr Homog. | 2080 | 60 | 7.37 | C12 | 146 |
| 16 | '839w/Cr Homog. | 2300 | 60 | 7.36 | C21 | 119 |

For convenience of comparison, Table 3 summarizes the production processes for the samples in the "Process" column as follows: "HFA" refers to the present invention's HFA process; "'839" refers to the process of the '839 patent which includes a carbon homogenization treatment; and "CQT" refers to the combined carburization/quench/temper treatment of the present HFA process. As in Table 1, the predicted rolling contact fatigue limit is a theoretical value which is the maximum cyclic rolling contact stress which can be applied to a rolling sample of the material which never results in sample failure.

Table 3 demonstrates that P/M materials prepared by the process of the '839 patent (with or without chromium) have much lower surface hardness than either non-chromium HFA material or chromium-containing HFA material. The material prepared by the process of the '839 patent also exhibits poor predicted fatigue limits relative to either non-chromium HFA material or chromium-containing HFA material.

The HFA material prepared by the HFA process of the present invention also has cost advantages relative to material prepared by the '839 parent's process. The atomized iron powder starting materials of the HFA process are low cost and are significantly less expensive than those used in the '839 parent's process, wherein expensive electrolytic iron powder is preferred. Although both the atomized iron powders used in the HFA process and the electrolytic iron powders preferred in the '839 patent's process are high purity powders, the electrolytic production process is much more expensive than the atomization process. The homogenization process is also significantly more costly than the HFA process' carburization/quench/temper cycle because homogenization requires a long duration, high temperature furnace operation. The HFA process also does not include the time-consuming homogenization step of the '839 patent and significantly shortens production times by combining carburization, quench and temper treatment steps into a single operation.

HFA/Extrusion Method for Producing P/M Material

The present invention also provides three extrusion processes (referred to herein as the HFA/Extrusion processes) for producing parts having high density, high surface hardness and superior rolling contact fatigue properties. In the HFA/Extrusion processes, P/M parts are molded and sintered according to the limitations of steps one and two of the HFA process described above. The sintered compacts are then subjected to one of three processing sequences X, Y or Z as follows.

Processing Sequence X

In sequence X, after the sintering step (step two) described above for the HFA process, the sintered compact is not sized as in the HFA process. Instead, the sintered compact is extruded through a die to obtain a reduction in diameter of between about 2–6%, preferably between 2–4%. In the extrusion process, the sintered compacts are introduced into the top portion of a tapered die which is large enough at the top portion to hold the sintered part and which has a smaller, straight section at its bottom portion. The straight section gives the part its final outside profile and contributes good dimensional control. A ram at the top of the die applies a load of 5–30 ksi, which forces the part through the smaller diameter straight section, thereby reducing the diameter and increasing the length of the part. The extrusion process also densities the surface of the part, thereby improving the rolling contact fatigue properties of the part. The extruded part is then carburized to form a high carbon skin on the part to a depth of at least 0.010 inches, and preferably to a depth of between about 0.020 to about 0.040 inches. The heated carburized part is immediately quenched and then tempered as in the combined carburization/heat treatment operation of step four of the HFA process. The preferred carburization/quench/temper cycle for sequence X is identical to that of the HFA process described above.

Processing Sequence Y

In sequence Y, a sintered compact (processed through steps one and two of the HFA process) is sized as in step three of the HFA process (at between about 55–65 tsi and at room temperature). The sized part is then extruded through a die for a reduction in diameter of about 2–6%, preferably 2–4%, as described in sequence X. The extruded part is then carburized, quenched and tempered as in sequence X.

Processing Sequence Z

In sequence Z, a sintered part (processed through steps one and two of the above HFA process) is extruded through a die for a reduction in diameter of about 2–6%, preferably 2–4%. The extruded part is sized as in sequence Y, and the sized part is then carburized, quenched and tempered as in Sequence X.

Samples 17–19 were processed along sequences X and Y of the HFA/Extrusion process as follows. The parts were evaluated for density, surface hardness and predicted rolling contact fatigue limit as recorded in Table 4.

SAMPLE 17

A powder mix was prepared as used in Sample 11. The powder mix was molded at 50 tsi at room temperature. The green compact was sintered for 30 minutes in a nitrogen/hydrogen atmosphere at 2080° F. and the sintered compact was then sized at 60 tsi. The sized part was then extruded at 20 tsi to provide approximately 4% reduction in diameter. The extruded part was then subjected to the seven-step preferred carburization/quench/temper cycle set out above for the HFA process.

SAMPLE 18

A powder mix prepared as in Sample 11 was molded at 50 tsi and then sintered at 2080° F. for 30 minutes in a nitrogen/hydrogen environment. The sintered part was then extruded at 10 tsi to provide approximately 4% reduction in diameter. The extruded part was then carburized, quenched and tempered using the steps employed to produce Sample 17.

SAMPLE 19

A powder mix prepared as in Sample 11 was molded at 50 tsi and then sintered in a nitrogen/hydrogen environment for 30 minutes at 2300° F. The sintered compact was then extruded, carburized, quenched and tempered as was used to prepare Sample 18.

TABLE 4

PROPERTIES OF EXTRUDED HFA MATERIAL (SAMPLES 17–19)

| Sample (Grade) | Process | Sinter (°F.) | Re-press (tsi) | Density (g/cc) | Hard-ness | Predic-ted Fatigue Limit (ksi) |
|---|---|---|---|---|---|---|
| 17 | Y | 2080 | 60 | 7.61 | C47 | 240 |
| 18 | X | 2080 | — | 7.28 | C44 | 248 |
| 19 | X | 2300 | — | 7.32 | C45 | 226 |

The extruded samples 18 and 19 demonstrated wholly unexpected predicted rolling contact fatigue limits in excess of 225 ksi despite having low densities of approximately 7.3 g/cc. These densities of parts produced by the HFA/Extrusion processes are significantly lower than those for parts produced by the HFA process described above. The result is unexpected because predicted fatigue limits are very dependent on part density and a ferrous P/M part of 7.3 g/cc would ordinarily exhibit relatively low fatigue limits. It is believed that the unexpectedly superior predicted rolling contact fatigue limits of the HFA/Extrusion material occur because the extrusion densifies the surface of the part to a depth of about 0.020 inches. When carburized, this very dense surface layer appears to dominate the fatigue performance of the part.

An additional advantage of the HFA/Extrusion processes of routes X and Y is that the inside diameter of the part is not deformed during the extrusion process and remains at a lower density than the part's outside skin. Because of this relative low density, it is much easier to carburize the part because the carburizing gas readily penetrates the part's low density region. This provides significant economic advantages due to shorter furnacing times.

Eight additional samples of HFA/Extrusion material (Samples 20–27) were prepared by either sequence X or Y above. The density, Rockwell C hardness, and predicted rolling contact fatigue limit for Samples 20–27 are recorded in Table 5. Each of Samples 20–27 was prepared from a powder mix identical to that used to produce Sample 11. To produce each sample, the powder mix was molded at 50 tsi to provide a green compact having a density of approximately 7.20 g/cc. Each green compact was sintered for 30 minutes in a nitrogen/hydrogen atmosphere at the temperatures indicated in Table 5. The sintered compacts processed by sequence X (Samples 20–23) were then extruded at 20 tsi to provide a diameter reduction of approximately 4%. The sintered compacts processed by sequence Y (Samples 21–27) were first sized at 60 tsi and then extruded at 20 tsi to provide a diameter reduction of 4%. The extruded parts of Samples 20–27 were then carburized, quenched and tempered using the seven-step preferred carburization/quench/temper cycle of the HFA process.

TABLE 5

PROPERTIES OF EXTRUDED HFA MATERIAL (SAMPLES 20–27)

| Sample | Process | Sinter Temp. (°F.) | Final Density (g/cc) | Hardness ($R_c$) | Predicted Fatigue Limit (ksi) |
|---|---|---|---|---|---|
| 20 | X | 2080 | 7.28 | 44 | 248.7 |
| 21 | X | 2080 | 7.28 | 44 | 267.5 |
| 22 | X | 2300 | 7.32 | 46 | 225.6 |
| 23 | X | 2300 | 7.32 | 45 | 244.2 |
| 24 | Y | 2080 | 7.61 | 47 | 214.3 |
| 25 | Y | 2080 | 7.61 | 47 | 240.0 |
| 26 | Y | 2300 | 7.67 | 49 | 220.4 |
| 27 | Y | 2300 | 7.67 | 49 | 220.3 |

What is claimed:

1. A method for producing a sintered ferrous material having high density, high surface hardness and desirable rolling contact fatigue properties, the method comprising the steps of:

compacting a portion of a powder at about 40 to about 50 tsi to provide a green compact, said powder comprising iron and iron alloys and being substantially free of graphite;

heating said green compact in an inert, non-oxidizing environment at a temperature between about 2050° F. to about 2300° F. to provide a sintered compact;

repressing said sintered compact at about 60 tsi to provide a repressed compact;

carburizing said repressed compact in a controlled environment at high temperature to introduce carbon into said repressed compact to thereby provide said compact with a layer of relatively high carbon concentration to a depth of at least about 0.010 inches, said carburizing step thereby providing a heated carburized compact at a temperature greater than room temperature;

quenching said heated carburized compact to bring the temperature of said carburized compact to about room temperature to provide a quenched compact; and tempering said quenched compact to provide a tempered compact.

2. The method of claim 1 wherein said powder comprises one or more compounds selected from particulate high purity iron and particulate high purity iron alloys.

3. The method of claim 2 wherein said powder comprises particulate high purity iron comprising no more than about 0.02 weight percent carbon, no more than about 0.15 weight percent oxygen, and no more than about 0.025 weight percent sulfur.

4. The method of claim 1 wherein said powder comprises one or more particulate high purity iron alloys.

5. The method of claim 4 wherein said particulate iron alloys are one or both selected from particulate iron-molybdenum and particulate iron-nickel-molybdenum.

6. The method of claim 5 wherein said particulate iron alloy comprises particulate iron-molybdenum, said particulate iron-molybdenum consisting essentially of about 0.8 to about 1.5 weight percent molybdenum, and the balance iron and incidental impurities.

7. The method of claim 6 wherein said incidental impurities in said particulate iron-molybdenum comprise no more than about 0.02 weight percent carbon, no more than about 0.15 weight percent oxygen, and no more than about 0.025 weight percent sulfur.

8. The method of claim 5 wherein said particulate iron alloy comprises particulate iron-nickel-molybdenum, said particulate iron-nickel-molybdenum consisting essentially of about 0.5 to about 1.8 weight percent nickel, about 0.6 weight percent molybdenum, and the balance iron and incidental impurities.

9. The method of claim 8 wherein said incidental impurities in said particulate iron-nickel-molybdenum comprise no more than about 0.02 weight percent carbon, no more than about 0.15 weight percent oxygen, and no more than about 0.025 weight percent sulfur.

10. The method of claim 1 wherein said compacting step is conducted at about 50 tsi.

11. The method of claim 10 wherein said compacting step is conducted at room temperature.

12. The method of claim 11 wherein said green compact has a density greater than about 7.00 g/cc.

13. The method of claim 12 wherein said green compact has a density greater than about 7.15 g/cc.

14. The method of claim 1 wherein in said heating step said non-oxidizing environment is a vacuum, nitrogen/hydrogen gas, or hydrogen gas.

15. The method of claim 14 wherein said heating step is conducted at a temperature of about 2080° F. to about 2300° F. for a period of 30–60 minutes at temperature.

16. The method of claim 1 wherein said repressing step is conducted at room temperature.

17. The method of claim 16 wherein said repressed compact has a density of about 7.50 to about 7.70 g/cc.

18. The method of claim 17 wherein in said carburizing step the repressed compact is subjected to a carbon-containing environment at a temperature of between about 1600° F. to about 1750° F. for period of time necessary to produce a high carbon layer to a depth of at least 0.010 inches on the repressed compact.

19. The method of claim 18 wherein in said carburizing step the repressed compact is subjected to a carbon-containing environment at a temperature of between about 1600° F. to about 1750° F. for period of time necessary to produce a high carbon layer to a depth of between about 0.020 to about 0.040 inches on the repressed compact.

20. The method according to claims 18 or 19 wherein in said carburizing step, said carbon introduced into said repressed compact is substantially retained in said high carbon layer and does not substantially diffuse into the interior of said repressed compact.

21. The method of claim 1 wherein said carburizing step includes the steps of:

heating the repressed compact in said controlled atmosphere from room temperature to about 1400° F. in about one hour;

increasing the carbon potential of said controlled atmosphere to between about 0.9% to about 1.1% carbon;

increasing the temperature of said repressed compact to 1750° F. and holding said repressed compact at that 1750° F. for about 1.25 hours;

cooling said repressed compact to 1600° F. and adjusting the carbon potential of said controlled environment to about 0.7% to about 0.8% carbon; and holding said repressed compact at 1600° F. for about 2.5 hours.

22. The method of claim 22 wherein after said carburizing step said carburized compact has a density of about 7.50 to about 7.70 g/cc.

23. The method of claim 1 wherein in said quenching step said carburized compact is quenched immediately after removal from said controlled environment of said carburizing step.

24. The method of claim 21 wherein after said step of holding said compact at 1600° F. for about 2.5 hours and immediately before said quenching step, said carburized compact is cooled to about 1500° F.

25. The method of claim 24 wherein in said quenching step said carburized compact is quenched in oil.

26. The method of claim 1 wherein in said tempering step the quenched compact is heated to between about 325° F. to about 500° F. for a period of time at temperature to provide a tempered compact having a Rockwell C hardness of between about 45 to about 58.

27. The method of claim 26 wherein in said tempering step said quenched compact is heated to about 400° F. and held at temperature for about 60 minutes.

28. The method of claim 1 wherein said carburizing step, said quenching step and said tempering step are combined into a carburizing/quenching/tempering procedure comprising the steps of:

heating the repressed compact in said controlled atmosphere from room temperature to about 1400° F. in about one hour;

increasing the carbon potential of said controlled atmosphere to between about 0.9% to about 1.1% carbon;

increasing the temperature of said repressed compact to 1750° F. and holding said repressed compact at that 1750° F. for about 1.25 hours;

cooling said repressed compact to 1600° F. and adjusting the carbon potential of said controlled environment to about 0.7% to about 0.8% carbon;

holding said repressed compact at 1600° F. for about 2.5 hours to provide a carburized compact;

cooling said carburized compact to about 1500° F. and immediately quenching said carburized compact in oil; and tempering said quenched compact at 400° F. for 60 minutes at temperature.

29. The method of claim 4 wherein said particulate iron alloys are particulate stainless steels.

30. The method of claim 29 wherein said particulate stainless steel are selected from the AISI type 400 and type 300 series stainless steels.

31. The method of claim 1 wherein said powder comprises up to about 20 weight percent of particulate AISI type 410 stainless steel.

32. The method of claim 4 wherein said particulate iron alloys are particulate high speed steels.

33. The method of claim 32 wherein said particulate high speed steels comprise up to 20 weight percent of said powder.

34. The method of claim 33 wherein said high speed steels are selected from M2 high speed tool steel, low carbon M2 high speed tool steel, M3/2 high speed tool steel, M4 high speed tool steel, and T15 high speed tool steel.

35. The method of claim 1 wherein said powder comprises up to 20 weight percent M2 tool steel powder, said M2 tool steel powder comprising about 0.85 weight percent carbon, about 4.0 weight percent chromium, about 5.0 weight percent molybdenum, about 6.2 weight percent tungsten, about 2.0 weight percent vanadium, and the balance iron and incidental impurities.

36. The method of claim 1 wherein said powder comprises one or more carbon-containing alloy selected from low carbon iron-chromium alloy, particulate low carbon iron-manganese alloy, and particulate low carbon iron-vanadium powders.

37. A sintered ferrous material produced by the process of claim 1.

38. The sintered ferrous material of claim 37 wherein said material has a density between about 7.50 to about 7.70 g/cc, a Rockwell C surface hardness of about 60, and a predicted rolling contact fatigue limit of at least about 220 ksi.

39. A method for producing a sintered ferrous material having high density, high surface hardness and desirable rolling contact fatigue properties, the method comprising the steps of:

compacting a portion of a powder at about 40 to about 50 tsi to provide a green compact, said powder comprising iron and iron alloys and being substantially free of graphite;

heating said green compact in an inert, non-oxidizing environment at a temperature between about 2050° F. to about 2300° F. to provide a sintered compact;

extruding the sintered compact through a die to obtain a reduction in diameter of about 2% to about 6% to provide an extruded compact;

carburizing said extruded compact at high temperature to introduce carbon into said extruded compact to thereby provide said compact with a layer of relatively high carbon concentration to a depth of at least about 0.010 inches, said carburizing step thereby providing a heated carburized compact at a temperature greater than room temperature;

quenching said heated carburized compact to bring the temperature of said carburized compact to about room temperature to provide a quenched compact; and tempering said quenched compact to provide a tempered compact.

40. The method of claim 39 wherein in said extruding step the sintered compact is reduced in diameter by about 2% to about 4%.

41. The method of claim 39 wherein in said extruding step, the sintered compact is extruded through said die by applying a force of about 5 ksi to about 30 ksi to the sintered compact.

42. A sintered ferrous material produced by the process of claim 39.

43. A method for producing a sintered ferrous material having high density, high surface hardness and desirable rolling contact fatigue properties, the method comprising the steps of:

compacting a portion of a powder at room temperature at about 40 to about 50 tsi to provide a green compact, said powder comprising iron and iron alloys and being substantially free of graphite;

heating said green compact in an inert, non-oxidizing environment at a temperature between about 2050° F. to about 2300° F. to provide a sintered compact;

repressing said sintered compact at room temperature at about 60 tsi to provide a repressed compact;

extruding said repressed compact through a die for a reduction in diameter of about 2% to about 6% to provide an extruded compact;

carburizing said extruded compact at high temperature to introduce carbon into said extruded compact and thereby provide said compact with a layer of relatively high carbon concentration to a depth of at least about 0.010 inches, said carburizing step thereby providing a heated carburized compact at a temperature greater than room temperature;

quenching said heated carburized compact to bring the temperature of said carburized compact to about room temperature to provide a quenched compact; and tempering said quenched compact to provide a tempered compact.

44. The method of claim 43 wherein in said extruding step the repressed compact is reduced in diameter by about 2% to about 4%.

45. The method of claim 43 wherein in said extruding step, the repressed compact is extruded through said die by applying a force of about 5 ksi to about 30 ksi to said repressed compact.

46. A sintered ferrous material produced by the process of claim 43.

47. A method for producing a sintered ferrous material having high density, high surface hardness and desirable rolling contact fatigue properties, the method comprising the steps of:

compacting a portion of a powder at about 40 to about 50 tsi to provide a green compact, said powder comprising iron and iron alloys and being substantially free of graphite;

heating said green compact in an inert, non-oxidizing environment at a temperature between about 2050° F. to about 2300° F. to provide a sintered compact;

extruding the sintered compact through a die to obtain a reduction in diameter of about 2% to about 6% to provide an extruded compact;

repressing said sintered compact at room temperature at about 60 tsi to provide a repressed compact;

carburizing said extruded compact at high temperature to introduce carbon into said extruded compact and thereby provide said compact with a layer of relatively high carbon concentration to a depth of at least about 0.010 inches, said carburizing step thereby providing a heated carburized compact at a temperature greater than room temperature;

quenching said heated carburized compact to bring the temperature of said carburized compact to about room temperature to provide a quenched compact; and tempering said quenched compact to provide a tempered compact.

48. A sintered ferrous material produced by the process of claim 47.

* * * * *

UNITED STATES PATENT AND TRADEMARK OFFICE

CERTIFICATE OF CORRECTION

PATENT NO. : 5,613,180

DATED : March 18, 1997

INVENTOR(S) : John C. Kosco

It is certified that error appears in the above-indentified patent and that said Letters Patent is hereby corrected as shown below:

Col. 1, line 65, delete "ms" and substitute therefor -- is --.

Col. 16, lines 42 and 45, delete "parent's" and substitute therefor -- patent's --.

Signed and Sealed this

First Day of July, 1997

Bruce Lehman

*Attest:*

BRUCE LEHMAN

*Attesting Officer*

*Commissioner of Patents and Trademarks*